US008348310B2

(12) United States Patent
Vázquez et al.

(10) Patent No.: US 8,348,310 B2
(45) Date of Patent: Jan. 8, 2013

(54) HOLD OPEN LEVER INTEGRATED TO LATCH HOUSING

(75) Inventors: Francisco Javier Vázquez, Chihuahua (MX); Eduardo Estrada, Chihuahua (MX); Alfredo Martinez, Chihuahua (MX)

(73) Assignee: Inteva Products, LLC, Troy, MI (US)

( * ) Notice: Subject to any disclaimer, the term of this patent is extended or adjusted under 35 U.S.C. 154(b) by 176 days.

(21) Appl. No.: 12/851,212

(22) Filed: Aug. 5, 2010

(65) Prior Publication Data

US 2011/0031765 A1 Feb. 10, 2011

Related U.S. Application Data

(60) Provisional application No. 61/231,846, filed on Aug. 6, 2009.

(51) Int. Cl.
*E05C 3/06* (2006.01)
*E05C 3/16* (2006.01)

(52) U.S. Cl. ..... 292/217; 292/216; 292/DIG. 23

(58) Field of Classification Search ..... 292/DIG. 38, 292/217

See application file for complete search history.

(56) References Cited

U.S. PATENT DOCUMENTS 3,773,368 A * 11/1973 Atwood et al. ..... 292/48
4,775,176 A * 10/1988 Ikeda ..... 292/216
4,917,420 A 4/1990 Rogers, Jr.
5,156,424 A * 10/1992 Nakamura et al. ..... 292/52
5,618,069 A 4/1997 Konchan et al.
5,897,148 A * 4/1999 Arabia et al. ..... 292/216
6,109,674 A * 8/2000 Bartel et al. ..... 292/216
6,364,379 B1 4/2002 Roberts et al.
6,378,920 B1 * 4/2002 Ostrowski et al. ..... 292/216
6,601,883 B1 * 8/2003 Kalsi ..... 292/216
6,767,038 B1 * 7/2004 Huml ..... 292/158
6,866,311 B2 * 3/2005 Spurr et al. ..... 292/216
7,455,336 B2 * 11/2008 Baumchen et al. ..... 292/216
2011/0012376 A1 * 1/2011 Hunt et al. ..... 292/216

FOREIGN PATENT DOCUMENTS

EP 1464779 A1 10/2004

OTHER PUBLICATIONS

International Search Report dated Mar. 15, 2011 for International Application No. PCT/US2010/044564.
Written Opinion dated Mar. 15, 2011 for International Application No. PCT/US2010/044564.

* cited by examiner

*Primary Examiner* — Thomas Beach
*Assistant Examiner* — Faria Ahmad
(74) *Attorney, Agent, or Firm* — Cantor Colburn LLP

(57) ABSTRACT

A compartment latch is shown. It includes a fork bolt that moves between an open position and a closed position and a first detent lever that that cooperates with the fork bolt and that moves between a latched position and a released position. A support for holding the fork bolt and the detent lever is also provided. A second detent lever for biasing against the first detent lever when the first detent lever is in the released position is provided. The second detent lever is connected to the support at a hinge.

13 Claims, 2 Drawing Sheets

HOLD OPEN LEVER INTEGRATED TO LATCH HOUSING

CROSS REFERENCE TO RELATED APPLICATIONS

This application claims the benefit of U.S. Provisional Patent Application Ser. No. 61/231,846 filed Aug. 6, 2009 the contents of which are incorporated herein by reference thereto.

BACKGROUND OF THE INVENTION

Certain passenger vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Other vehicles have sliding doors that run horizontally on a track between an opened and closed position. Each of the deck lid, lift gate or sliding door can be thought of as panels that allow access to the interior of the vehicle compartment. Compartment latches, enable each of these types of panels to be secured and closed.

When it is desired to open these panels, it is known to use a remote unlatch mechanism that releases a detent lever from engagement with a fork bolt, allowing a striker pin to be removed from the catch (or throat) of the fork bolt. Advantageously, the deck lid, lift gate or sliding door will release from the striker pin and bias away from the striker due to shocks, springs, motors etc. incorporated in these panels. However, when the panel does not bias away, the remote unlatch mechanism that causes the detent lever to be released from engagement with the fork bolt is de-energized. As a result, the detent lever risks falling back into engagement with the fork bolt—and the panel cannot be opened. When the panel does not automatically bias open upon release of the detent lever from the fork bolt, it would be advantageous to maintain the detent lever in a released position until such time as the panel can be manually opened. Normally this is done with multiple additional parts which adds complexity and cost to a latch.

SUMMARY OF THE INVENTION

Various exemplary embodiments of the invention allow a detent lever of a latch to stay in a released position. This can be useful when a door or lid that is held closed by the latch is intended to be open, but does not act in the desired fashion due to a malfunction not associated with the latch.

According to one embodiment of the invention, a compartment latch is provided. It includes a fork bolt that moves between an open position and a closed position and a first detent lever that that cooperates with the fork bolt and that moves between a latched position and a released position. A support for holding the fork bolt and the detent lever is also provided. A second detent lever for biasing against the first detent lever when the first detent lever is in the released position is provided. The second detent lever is connected to the support at a hinge.

According to another embodiment of the invention, a latch including a fork bolt that moves between an open position and a closed position and a first detent lever that cooperates with the fork bolt and moves between a latched position and a released position in a first plane is provided. A hook or feature extends from the first detent lever and is in a second plane. A second detent lever is also provided. The second detent lever is in the second plane. A stop portion extends from the second detent lever and is in the second plane and biases against the hook or feature when the first detent lever is in the released position.

According to yet another embodiment of the invention, a latch including a fork bolt that moves between an open position and a closed position and a first detent lever that that cooperates with the fork bolt and moves between a latched position and a released position is provided. A second detent lever for biasing against the first detent lever when the first detent lever is in the released position is provided. The second detent lever is integrally formed as part of a housing supporting the fork bolt and the detent lever.

In another embodiment, a method for holding open a detent lever of a latch assembly is provided. The method comprising: integrally forming a hold open lever with a housing of the latch assembly, wherein the housing and the hold open lever are formed from plastic and the hold open lever is biased into a first position such that a stop portion will engage a feature of the detent lever as it is moved between an engaged position and a disengaged position, when the detent lever is in the engaged position, a surface of a fork bolt is engaged by a surface of the detent lever and the fork bolt is prevented from moving toward an unlatched position from a latched position; and contacting the feature of the detent lever with the stop portion when the detent lever is in the disengaged position such that the detent lever is prevented from moving the engage position.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
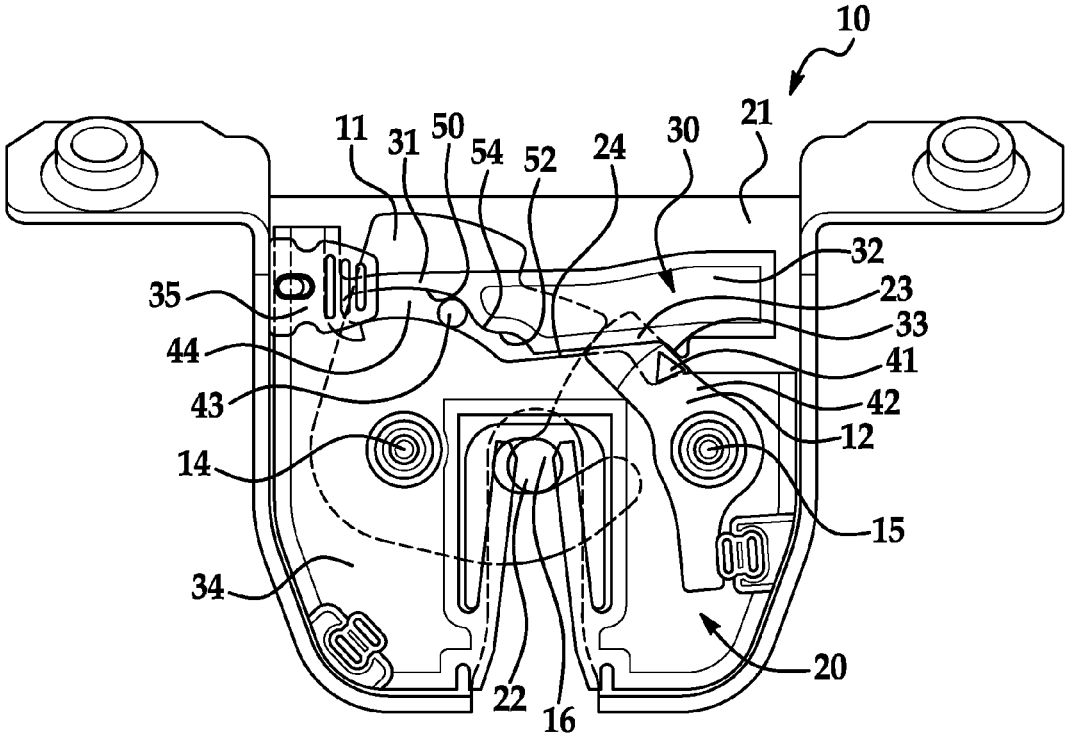
FIG. 1 is an illustration showing a latch in a first or closed position.

Referring now to the Figures embodiments of the invention will be described with reference to specific embodiments, without limiting same, FIGS. 1-4 shows a latch or latch assembly 10, with one cover of the latch 10 removed to facilitate illustrating the inner workings of the latch 10. In the exemplary embodiment shown, latch 10 is a compartment latch. A compartment latch 10 of the type shown is useful for the rear compartment, such as a trunk of a vehicle. The latch 10 can keep the trunk lid latched, can keep a lift gate of a vehicle latched or a sliding door of vehicle closed, such as a van door. However, the invention is applicable to any environment where the features of the invention are desired. For example, the latch assembly can be attached to a vehicle structure such that the fork bolt is moved between the open position and the closed position when a hood, door, window, lift gate, etc. is opened and closed and the fork bolt engages a striker that is attached to the hood, door, window, lift gate, etc.

Alternatively, the latch assembly can be secured to the hood, door, window, lift gate, etc. and the striker is secured to the vehicle body at an opening into which the hood, door, window, lift gate, etc. is received.

Latch 10, located on a first element, such as trunk lid (not shown) includes a fork bolt 11 and a detent lever 12. Fork bolt 11 is capable of rotation about first stud 14, while detent lever 11 is a capable of rotation about a second stud 15. A striker 16 is attached to a second element, such as the vehicle body and is adapted to engage the fork bolt 11 to cause latching of the trunk lid to the vehicle body.

In accordance with an exemplary embodiment, the fork bolt is capable of movement between a first or latched position wherein a striker is engaged by a throat of the fork bolt and a second or open position wherein the striker is free to be released from the throat of the fork bolt. The housing of the latch will also have a complimentary opening for receipt of the striker therein when it is engaged or latched by the fork bolt. The fork bolt is spring biased into the second or open position. In addition and in order to retain the latch assembly or fork bolt in the latched position, the detent lever is pivotally secured to the latch assembly for movement between an engaged position and a disengaged position. When the detent lever is in the engaged position, a surface of the fork bolt is engaged by a surface of the detent lever and the fork bolt is prevented from moving toward the unlatched position from the latched position. In one implementation, a first spring is provided for biasing the fork bolt into the open position while a second spring is provided for biasing the detent lever in the direction of the engaged position, such that movement of the fork bolt to the latched position will cause the detent lever to move to the engaged position.

In accordance with exemplary embodiments of the present invention, the fork bolt has an engagement surface or contact surface that slides along and makes contact with a complimentary engagement surface or contact surface of the detent lever when the fork bolt pivots or moves from the open or unlatched position to the closed or latched position and once in the closed position a surface of the fork bolt engages a surface of the detent lever thus engaging the fork bolt and securing it into the closed position when the striker is secured in a receiving opening of the fork bolt. Once the latch is in the closed position the detent lever is spring biased into contact with the fork bolt such that the fork bolt cannot rotate into the open position unless the detent lever is moved back to the release or disengaged detent position.

In order to move the detent lever to the release or disengaged position a release mechanism coupled to the detent lever is configured to move the detent lever from the engaged position to the disengaged position upon actuation of the release mechanism.

Figure 2:
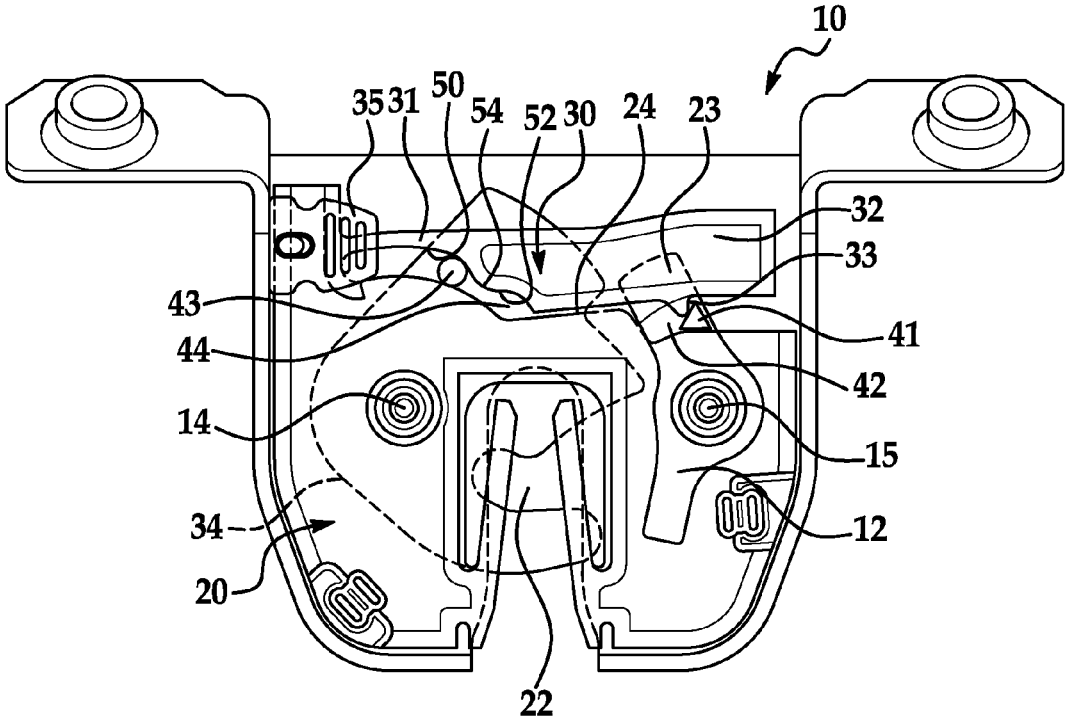
FIGS. 2 and 3 are illustrations showing the latch moving towards a second or open position.
Figure 3:
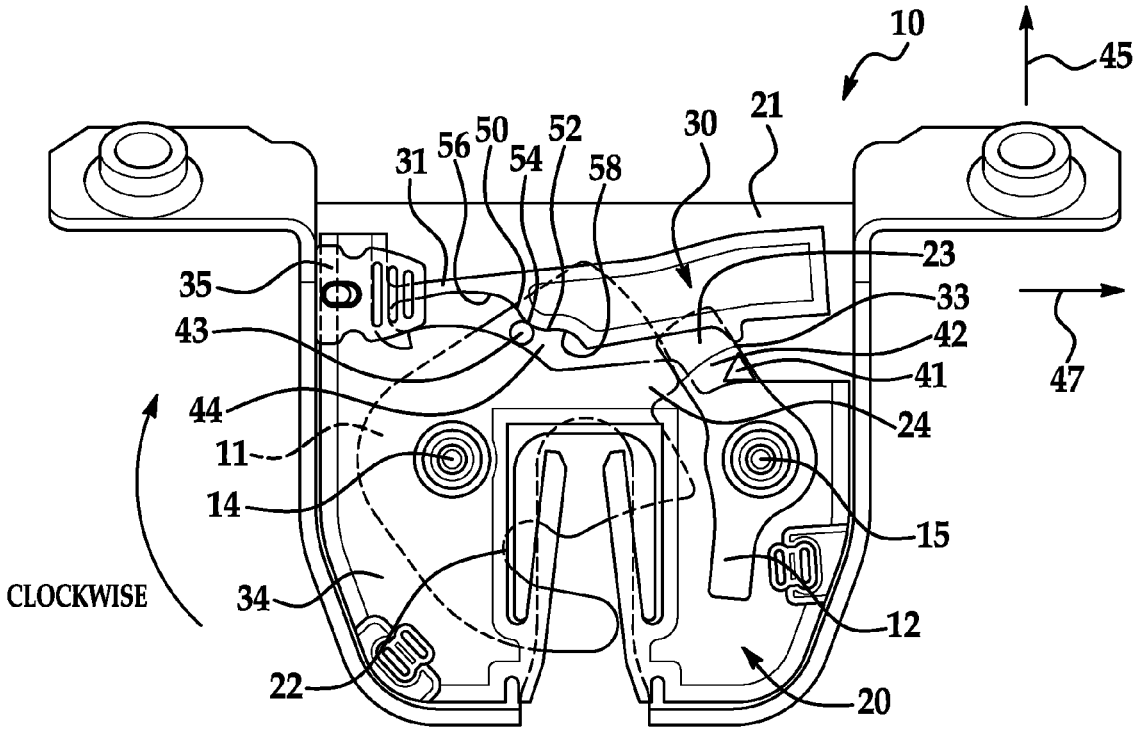
Figure 4:
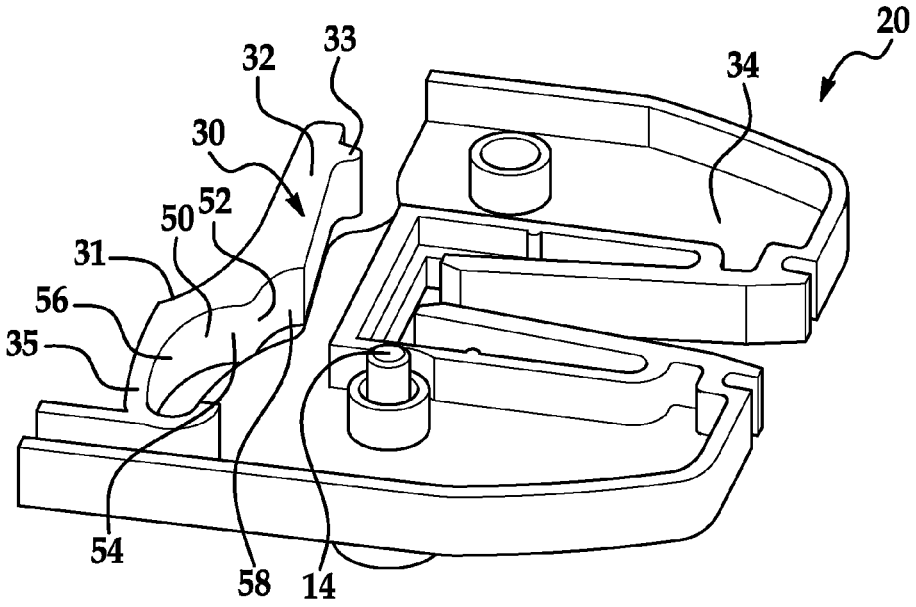
FIG. 4 is an illustration showing a housing of the latch assembly.

As seen in FIGS. 1-3, a housing portion 20 is shown in the foreground of each of FIGS. 1-3. Fork bolt 11 and detent lever 12 are each adjacent and attached to a support portion 21, shown as a rear wall 21 of latch 10, and are shown partially in phantom. Housing portion 20 is best shown in FIG. 4. When fork bolt 11 and detent lever 12 are in a closed and latched position in FIG. 1, a striker 16 is captured in a throat 22 of fork bolt 11. An upper arm 23 of detent lever 12 cooperates with a shoulder portion 24 of fork bolt 11 to retain latch 10 in the closed position.

Referring now to FIG. 2, detent lever 12 has been rotated clockwise towards a released or disengaged position. In this position, upper arm 23 has been moved out of engagement with shoulder portion 24, allowing fork bolt to rotate clockwise, as shown in FIG. 3. The fork bolt open position of FIG. 3 allows striker 16 slide out of throat 22 and further rotate the fork bolt in the clockwise direction until the striker is completely moved away from the latch or out of the latch assembly.

In operation, latch 10 is moved from the latched position of FIG. 1 to the unlatched position of FIG. 3 by initiating rotation of detent lever 12 in a clockwise rotation against a spring bias (not shown). Rotation force can be initiated manually or by an automatic lock-unlock mechanism (not shown). Once the rotation force is released, the spring bias acting on detent lever 12 will cause detent lever to rotate in a counterclockwise movement until detent lever 12 again engages fork bolt 11. Similarly and the detent lever is in the disengaged position, a spring force will rotate the fork bolt into the unlatched or open position. If fork bolt 11 has not rotated to the open position shown in FIG. 3, upper arm 23 of detent lever 12 will again engage shoulder portion 24 of fork bolt 11, causing latch and the fork bolt to remain in the latched position. This situation may occur when, for example, the pistons that cause trunk lid or lift gate to open do not function properly. In another example, a snow load placed on the trunk lid (or another weight) may prevent the trunk lid from opening when detent lever 12 is rotated out of the closed position. Thus, when the rotation force on detent lever 12 is released and striker 16 has not been removed from throat 22, detent lever 12 rotates back to the closed position. The trunk lid or other device used by latch 10, therefore, does not open as intended.

In the exemplary embodiment shown, housing portion 20 is provided with an integrally formed housing arm, second detent lever or hold open lever 30 that includes a cantilever portion 31, a hold open arm portion 32 and a stop portion or feature 33 depending or extending from hold open arm portion 32. By integrally forming the housing arm or hold open lever with the housing this negates the need for a separate spring for the housing arm or hold open lever as well as an addition assembly operation each or which will save associated manufacturing costs.

In one exemplary embodiment, the housing portion and the housing arm is formed of a plastic or other equivalent easily molded material or equivalents thereof that is integrally molded with the housing for example at the same time the housing is formed. Alternatively, the housing arm may be inserted molded into the housing or still in another alternative fixed to the housing separately. Although exemplary embodiments are directed to a plastic housing and housing arm other equivalent materials are considered to be with the scope of various embodiments of the invention.

Cantilever portion 31 is connected to the main body section 34 of housing portion 20 at a biasing portion, shown as a living hinge portion 35. Detent lever 12 includes a hook or feature 41 raised in relief off of a front surface 42 of detent lever 12 so that it projects toward housing portion 20 and is configured to releasably engage stop portion 33 of housing arm 30, as will be described in detail hereinafter. In one non-limiting exemplary embodiment, feature 41 is formed from an encapsulation provided upon the detent lever for example, a thermoplastic elastomer or other equivalent material applied to the detent lever, which may be formed from steel, metal, plastic or any other suitable material. Fork bolt 11 includes a finger or feature 43 extending from the front surface 44 of fork bolt 11 toward housing portion 20 in a manner complementary to hook 41, as will be described hereinafter. In one non-limiting exemplary embodiment, feature 43 is also formed from an encapsulation provided upon the fork bolt for example, a thermoplastic elastomer or other equivalent material applied to the fork bolt, which may be formed from steel, metal, plastic or any other suitable material.

Referring again to FIG. 1 when detent lever 12 is rotated clockwise, hook or feature 41 moves past stop portion 33 by sliding along first complementary edges of each. In addition, housing arm 30 will move upwardly in the direction of arrow 45. Housing arm 30 or at least living hinge portion 35 will be formed out of a material having resilient characteristics such that a biasing force in a direction opposite to arrow 45 is provided. Accordingly, as hook or feature 41 contacts and moves in the direction or arrow 47 or as detent lever 12 moves in a clockwise direction housing arm 30 moves upward in the direction of arrow 45 and then after feature or hook 41 moves past stop portion 33 the biasing force of the housing arm or the living hinge will move the same in a direction opposite to arrow 45 and stop portion 33 will no be in a position to contact hook or feature 41 as it tries to move in a direction opposite to arrow 47 or in a counter clockwise motion as illustrated in the Figures.

As discussed above, contact of hook portion or feature 41 with stop portion or feature 33 causes housing arm 30 to rotate in a counterclockwise motion from a first rest position to a second biased position, about living hinge portion 35, until hook 41 moves past stop portion 33, as shown in FIG. 2. Thereafter, living hinge portion 35 biases housing portion 30 back to the first rest position. In this position, hook 41 engages stop portion 33 at second complementary edges, thus preventing detent lever 12 from biasing back counterclockwise to a closed or rest position. Since detent lever 12 is held in this released position by housing arm 30, fork bolt 11 is free to rotate to the fork bolt open position, and release striker 16 from throat 22, shown in FIG. 3, whenever an external force is applied to latch 10. Stop portion 33 acts as a secondary detent that holds primary detent lever 12 from returning to the closed or rest position.

Detent lever 12 will be maintained in released position of FIG. 2 until fork bolt 11 rotates clockwise to the open position shown in FIG. 3. Upon rotation of fork bolt 11, finger 43 pushes against hold open arm portion of housing arm 30, causing housing arm 30 to rotate about living hinge portion 35. This lifts stop portion 33 out of engagement with hook 41, allowing detent lever to bias back to the closed or rest position of FIG. 1 where upper arm 23 can then engage with shoulder portion 24 of fork bolt 11.

As illustrated, the hold open arm portion of the housing arm has cam surfaces 50 and 52 located on either side of a peak portion 54 such that movement of the fork bolt from a first or closed position to a second or open position will cause feature or finger 43 to engage cam surface 50 and cause the housing arm to move upward in the direction of arrow 45, which in turn will allow the detent lever to move counter clockwise since feature or hook 41 is free to pass stop portion or feature 33 when the housing arm is moved upward. In addition and as an alternative embodiment, cam surface 52 is also configured such that movement of the fork bolt form an open position to a closed position (counter clockwise) will also cause the housing arm to move upward and allow the movement of the detent lever in a counter clockwise manner. Also illustrated is that adjacent to each cam surface 50 and 52 is a relief area 56 and 58 configured to allow the housing arm to move downward in a direction opposite to arrow 45 such that stop portion or feature 33 is now in a position to engage hook or feature 41.

Accordingly, various embodiments disclosed herein allow fork bolt 11 to open to the position of FIG. 3, even after actuation of an automatic unlock mechanism has not caused fork bolt 11 to release striker 16. The hold open lever, which in one embodiment is integrally formed with the housing holds the detent lever 12 in a released position until the fork bolt is, for example, lifted manually off of striker 16, such as might happen when a trunk lid is weighted down with snow. In the exemplary embodiment shown, this is achieved with a single plastic component, housing portion 20 having the living hinge portion 35 about which the housing arm 30 can rotate and engage with detent lever 12. Accordingly and in one exemplary embodiment, the hold open lever or housing arm is formed as an integral tab portion of the housing portion in a cantilever fashion that allows the hold open lever or housing arm to have a return spring bias via a living hinge off of the base of the lever. Still further this is achieved by a single housing component that is also configured to house other components of the latch assembly. This single housing component is illustrated in at least FIG. 4. As illustrated in at least FIGS. 1-3, the fork bolt and the detent lever are also configured to be movably received in the housing component 20.

As illustrated, the detent lever and the fork bolt are configured to be received within the housing and occupy and move or rotate in a first plane while the second detent lever or hold open lever occupies and moves or rotates a second plane, the first plane being different from the second plane. In addition, the latch may be configured such that the fork bolt and detent lever are disposed either above or below the hold open or second detent lever.

It will be apparent to one skilled in the art that modifications to the invention may be made. This may include, but not be limited to, substituting the plastic housing portion 20 with a different material and substituting living hinge portion 35 with a different type of hinge, or a spring or another bias member. The engagement and/or interface between housing arm 30 and detent lever 12 may take many variant forms, other that those described in the exemplary embodiment. All such variants are included within the scope of the present invention.

In another exemplary embodiment, a method for holding open a detent lever of a latch assembly is provided. The method comprising: integrally forming a hold open lever with a housing of the latch assembly, wherein the housing and the hold open lever are formed from plastic and the hold open lever is biased into a first position such that a stop portion will engage a feature of the detent lever as it is moved between an engaged position and a disengaged position, when the detent lever is in the engaged position, a surface of a fork bolt is engaged by a surface of the detent lever and the fork bolt is prevented from moving toward an unlatched position from a latched position; and contacting the feature of the detent lever with the stop portion when the detent lever is in the disengaged position such that the detent lever is prevented from moving the engage position. Still further the method may further comprise, allowing the detent lever to move from the disengaged position to the engaged position by moving the hold open lever from the first position to a second position, wherein the stop portion will not engage the feature of the detent lever when the hold open lever is in the second position. Still further the method may further comprise, moving the hold open lever from the first position to the second position by rotating the fork bolt such that a feature of the fork bolt engages a cam surface of the hold open lever.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A latch comprising:

a fork bolt that moves between an open position and a closed position;

a first detent lever that that cooperates with the fork bolt and moves between a latched position and a released position;

a support for holding the fork bolt and the first detent lever; and a second detent lever for biasing against the first detent lever when the first detent lever is in the released position, the second detent lever integrally molded to the support at a living hinge, the second detent lever being configured for movement between a first position and a second position, wherein the second detent lever is spring biased into the first position by only the living hinge and the second detent lever contacts the first detent lever when the first detent lever is in the release position and the second detent lever is in the first position thereby preventing movement of the first detent lever from moving from the released position to the latched position and wherein movement of the second detent lever from the first position to the second position is only facilitated by direct contact between a portion of the fork bolt and a portion of the second detent lever;

wherein the first detent lever and the fork bolt occupy a first plane and the second detent lever occupies a second plane; and wherein the second detent lever has a stop portion extending therefrom and the first detent lever has a feature extending therefrom for engaging the stop portion.

2. The latch of claim 1, wherein at least a portion of the support is plastic and the hinge is a living hinge is also plastic.

3. The latch of claim 2, wherein the second detent lever includes a stop portion and the first detent lever includes a feature for engaging the stop portion.

4. The latch of claim 1, wherein the second detent lever includes a stop portion and the first detent lever includes a feature for engaging the stop portion.

5. The latch of claim 1, wherein the stop portion and the feature occupy the second plane.

6. The latch of claim 1, wherein the second detent lever is a cantilever extending from the support.

7. The latch of claim 6, wherein the cantilever includes a living hinge portion adjacent a first end and a stop portion adjacent a second end for engaging the first detent lever and wherein the second detent lever is configured for movement between a first position and a second position, wherein the second end engages the first detent lever in the first position and the wherein the second end does not contact the first detent lever when it is in the second position.

8. The latch of claim 7, wherein the first detent lever includes a feature for engaging a stop portion of the second detent lever and wherein the fork bolt has a feature for engaging cam surfaces of the second detent lever in order to move the second detent lever from the first position to the second position as the fork bolt moves between the open position and the closed position.

9. A latch comprising:

a fork bolt that moves between an open position and a closed position;

a first detent lever that cooperates with the fork bolt and moves between a latched position and a released position in a first plane;

a feature extending from the first detent lever and in a second plane;

a second detent lever, the second detent lever in the second plane; and a stop portion extending from the second detent lever and in the second plane and biasing against the feature when the first detent lever is in the released position, the second detent lever being integrally molded with a housing of the latch by a living hinge and being configured for movement between a first position and a second position, wherein the second detent lever is spring biased into the first position by only the living hinge and the stop portion contacts the feature when the first detent lever is in the release position and the second detent lever is in the first position thereby preventing movement of the first detent lever from moving from the released position to the latched position and wherein movement of the second detent lever from the first position to the second position is only facilitated by direct contact between a portion of the fork bolt and a portion of the second detent lever;

wherein the first detent lever and the fork bolt occupy a first plane and the second detent lever occupies a second plane; and wherein the second detent lever has a stop portion extending therefrom and the first detent lever has a feature extending therefrom for engaging the stop portion.

10. The latch of claim 9, wherein the second detent lever and the housing are formed from plastic.

11. A latch comprising:

a fork bolt that moves between an open position and a closed position;

a first detent lever that that cooperates with the fork bolt and moves between a latched position and a released position; and a second detent lever for biasing against the first detent lever when the first detent lever is in the released position, the second detent lever integrally formed as part of a housing supporting the fork bolt and the detent lever, the second detent lever being configured for movement between a first position and a second position, wherein the second detent lever is spring biased into the first position by only a portion of the second detent lever integrally formed with the housing and the second detent lever contacts the first detent lever when the first detent lever is in the release position and the second detent lever is in the first position thereby preventing movement of the first detent lever from moving from the released position to the latched position and wherein movement of the second detent lever from the first position to the second position is only facilitated by direct contact between a portion of the fork bolt and another portion of the second detent lever;

wherein the first detent lever and the fork bolt occupy a first plane and the second detent lever occupies a second plane;

wherein the second detent lever has a stop portion extending therefrom and the first detent lever has a feature extending therefrom for engaging the stop portion; and wherein a portion of the second detent lever is a living hinge.

12. The latch of claim 11, wherein the second detent lever is cantilevered from the housing at the portion of the second detent lever.

13. The latch of claim 11, wherein the second detent lever, the housing and the living hinge are formed from plastic.

* * * * *